US007137910B2

(12) United States Patent
Ktson et al.

(10) Patent No.: US 7,137,910 B2
(45) Date of Patent: Nov. 21, 2006

(54) ROTATING WHEEL RETURN MECHANISM

(75) Inventors: James A. Ktson, Davisburg, MI (US); Frederick M. Allor, Traverse City, MI (US)

(73) Assignee: Grand Slam Sports, LLC, Southfield, MI (US)

( * ) Notice: Subject to any disclaimer, the term of this patent is extended or adjusted under 35 U.S.C. 154(b) by 31 days.

(21) Appl. No.: 11/028,857

(22) Filed: Jan. 4, 2005

(65) Prior Publication Data

US 2006/0148596 A1 Jul. 6, 2006

(51) Int. Cl.
*A63B 69/00* (2006.01)

(52) U.S. Cl. ..... 473/431; 473/451; 124/79; 124/34; 124/51.1

(58) Field of Classification Search ..... 473/431, 473/422, 451, 460; 124/16, 56, 6, 79, 34, 124/51.1

See application file for complete search history.

(56) References Cited

U.S. PATENT DOCUMENTS

| | | | | |
|---|---|---|---|---|
| 3,194,556 | A | 7/1965 | Vinson | |
| 3,930,486 | A | 1/1976 | Kahelin | |
| 4,273,095 | A | 6/1981 | Speer | |
| 4,275,883 | A | 6/1981 | Grimaldi et al. | |
| 4,643,423 | A | 2/1987 | Wright | |
| 4,657,250 | A * | 4/1987 | Newland et al. | 473/432 |
| 4,883,272 | A | 11/1989 | Lay | |
| 4,896,646 | A | 1/1990 | Kahelin et al. | |
| 4,913,427 | A | 4/1990 | Wilson | |
| 5,133,548 | A | 7/1992 | Bedord et al. | |
| 5,292,119 | A | 3/1994 | Norcross | |
| 5,333,855 | A | 8/1994 | Silin et al. | |
| 5,496,025 | A * | 3/1996 | Phillips et al. | 124/56 |
| 5,566,934 | A | 10/1996 | Black et al. | |
| 5,573,239 | A | 11/1996 | Ryker et al. | |
| 6,155,936 | A | 12/2000 | Dorr | |
| 6,189,889 | B1 | 2/2001 | Yip | |
| 6,348,028 | B1 * | 2/2002 | Cragg | 482/148 |
| 2005/0170915 | A1 | 8/2005 | Hollrock | |
| 2005/0209027 | A1 * | 9/2005 | Joseph | 473/431 |

* cited by examiner

*Primary Examiner*—Mitra Aryanpour
(74) *Attorney, Agent, or Firm*—Brooks Kushman P.C.

(57) ABSTRACT

A practice machine for receiving a thrown ball and returning it to a user is generally provided with a backstop for stopping the thrown ball, a pan disposed below the backstop for collecting the ball, a ball return adjacent the backstop for expelling the ball, and a trough disposed between the pan and the ball return for feeding the ball from the pan to the ball return. The ball return can adjust between ball sizes and vary the trajectory of expelled balls. Moreover, the ball return can be equipped with safety features including a proximity sensor, audible alerts, speed adjustment and tamper resistant controls. Further, the ball return can alternate between a MANUAL mode and an AUTOMATIC mode. The backstop of the practice machine can be collapsible to permit convenient storage and ease of transportation.

22 Claims, 8 Drawing Sheets

ROTATING WHEEL RETURN MECHANISM

BACKGROUND OF THE INVENTION

1. Field of the Invention

The present invention relates to a baseball or softball practice system and, more particularly, to a portable system for receiving a thrown ball and safely returning it to a user.

2. Background Art

Over the years, a wide variety of ball receipt and return machines have been developed for enhancing the defensive skills of baseball or softball players. A representative sample of such machines are illustrated in U.S. Pat. Nos. 4,883,272, 5,133,548, and 5,573,239. These devices typically have a rectangular frame for supporting a backstop, which provides a general throwing target. The backstop is frequently a net or tarp the sustaining the impact of thrown ball and allowing it to drop directly into a pan positioned below the target backstop. Often, machines of this variety are affixed with a feeding apparatus that delivers the ball to a return mechanism, which expels the ball into the general direction of the user. However, these machines furnish a dangerous practice environment, particularly to unsupervised children, whom are playing in the general vicinity of the machine or are actively using the device. Moreover, machines of this design lack certain features that provide a more versatile and comprehensive training system.

SUMMARY OF THE INVENTION

Accordingly, it is an aspect of the present invention to provide a practice machine that offers an expansive, flexible training system, which promotes efficiency during a practice session.

A practice machine for receiving a thrown ball and returning it to a user is provided with a backstop for stopping the thrown ball, a pan disposed below the backstop for collecting the ball, a ball return adjacent the backstop for expelling the ball, and a trough disposed between the pan and the ball return for feeding the ball from the pan to the ball return. The machine may include a housing, which defines an inner chamber generally enclosing the ball return. The ball return includes a rotatable wheel affixed to a spindle that is rotatably driven by a motor, a ball diameter adjustment mechanism, adjustable to permit balls of different diameters to be expelled, and a trajectory adjustment mechanism for varying the trajectory of the expelled ball regardless of ball diameter.

The trajectory adjustment mechanism may include an angle bracket disposed below the wheel and affixed to a base of the ball return. The angle bracket may have a pair of spaced-apart guide plates fixedly connected by at least one support brace therebetween. Moreover, each guide plate can include an arcuate slot. The trajectory adjustment mechanism may further include a generally U-shaped launch plate disposed between the guide plates of the angle bracket and slidably attached thereto via at least one pair of sliding members in sliding communication with the arcuate slots. The launch plate may have a ball engaging surface including a substantially constant pitch point. Thus, the launch plate can slide between the guide plates of the angle bracket along a semi-circumferential path defined by the arcuate slots such that the ball engaging surface is capable of moving from a substantially horizontal incline to a substantially vertical incline.

Further, the ball diameter adjustment mechanism may comprise of a slide base slidably affixed to an inner support wall and movable between at least two positions. The motor may be fixedly attached to the slide base such that sliding adjustment of the slide base causes the rotatable wheel to lift and lower to at least two fixed distances relative to the launch plate.

Additionally, the trajectory adjustment mechanism may further comprise at least one link rod having a proximal end and a distal end, wherein the proximal end is nearest the launch plate and fixedly attached thereto. The trajectory adjustment mechanism may also include at least one pivot arm, which pivots about a pivot axis, having a first end and a second end, wherein the first end is fixedly attached to the distal end of the link rod. Finally, the trajectory adjustment mechanism may have a lead screw having a threaded end internal to the housing and a crank end external to the housing, wherein the lead screw is affixed to the housing by a lock collar secured internal to the housing and a hand crank mounted external to the housing. The second end of the pivot arm may be threadably attached to the threaded end of the lead screw. Turning the crank can rotate the lead screw in place causing the second end of the pivot arm to slide along the threaded end of the lead screw such that the pivot arm pivots causing the first end and the link rod to move foreward and aftward, thereby varying the position of the launch plate along the arcuate slots of the angle bracket.

Alternatively, the launch plate can be electrically driven along the semi-circumferential path by a trajectory control motor and a trajectory control switch. In addition, the practice machine may be equipped with a speed control device for adjusting the speed with which the ball is expelled from the machine. Optionally, a speed control override is provided in communication with the speed control device for limiting the maximum speed at which the ball is expelled from the machine.

It is another aspect of the present invention to provide a practice machine that includes safety mechanisms for reducing the risk of accidents or injury.

Accordingly, a practice machine for receiving a thrown ball and returning it to a user is provided with a backstop for stopping the thrown ball, a pan disposed below the backstop for collecting the ball, a ball return adjacent the backstop for expelling the ball, and a trough disposed between the pan and the ball return for feeding the ball from the pan to the ball return. The machine may include an electro-mechanical stop affixed to the trough for obstructing the ball before it enters the ball return. The stop can be deployed by a proximity sensor, which detects motion within a specified danger zone, preventing the ball from being expelled from the machine. A danger zone control may be provided for adjusting the perimeter of the danger zone. Optionally, the danger zone control is tamper resistant.

The machine may further include a mode switch electrically coupled to the stop that toggles the machine between an AUTO mode and a MANUAL mode. In the AUTO mode, the stop is normally deactivated to permit balls to proceed unobstructed from the pan to the ball return. In the MANUAL mode, the stop is normally deployed to prevent the ball from entering the ball return. Upon receipt of a deactivation signal, the stop is deactivated to permit the ball to enter the ball return and be subsequently expelled thereby. The deactivation signal can be manually triggered by a user accessible trigger switch.

The trigger switch for sending the deactivation signal to the stop may be affixed to the housing or provided in a remote control. The remote control can transmit the deactivation signal either wirelessly or through a wired connection.

Moreover, the machine may further include a proximity sensor electrically coupled to the stop. The proximity sensor is capable of detecting motion within a specified danger zone. Upon motion detection, the proximity sensor activates the stop to prevent any balls from entering the ball return regardless of whether the machine is in the AUTO mode or the MANUAL mode.

Moreover, the machine may include a ball detection device disposed in a terminal end of the trough for detecting the presence of the ball and outputting an audible or visible alert, or both, signaling the ball's exodus.

Further, the machine may include a speed control device for adjusting the speed with which the ball is expelled from the ball return. A speed control override in communication with the speed control device can also be provided to limit the maximum speed attainable by the ball as it exits the ball return. The speed control override may also be tamper resistant.

Furthermore, the practice machine may have a housing defining an inner chamber, which generally encloses the ball return. The housing can be equipped with an ingress for receiving the ball into the ball return and an egress for permitting the ball to be expelled from the ball return. The housing may also include an access panel for providing access to the inner chamber. The access panel may be equipped with a tamper resistant latch to prevent unwanted access the inner chamber. The speed control override or danger zone control or other safety controls can be disposed within the inner chamber and accessible through an opening provided by the access panel when unlatched.

Yet another aspect of the present invention is to provide a practice machine that is conveniently stowable or easily portable from one practice location to another.

Accordingly, a backstop for stopping a thrown ball is provided having a collapsible frame and netting. The frame may include a plurality of collapsible upright support posts. Each upright support post may have a plurality of telescoping tubular members. Each telescoping tubular member may be capable of extending substantially end-to-end in an elongated configuration. Moreover, each telescoping tubular member may be capable of collapsing, one inside the next, in a collapsed configuration. The netting can be secured to the frame for providing a target for receiving the thrown ball. The netting may be formed from flexible material capable of collapsing with the frame. The backstop can be collapsible from a fully expanded target configuration when the plurality of telescoping tubular members are in the elongated configuration to a compact transportable configuration when the plurality of telescoping tubular members are in the collapsed configuration.

These and other aspects, object, features and advantages of the present invention will be more clearly understood and appreciated from a review of the following detailed description of the preferred embodiments and appended claims, and by reference to the accompanying drawings.

BRIEF DESCRIPTION OF THE DRAWINGS

The features of the present invention which are believed to be novel are set forth with particularity in the appended claims. The present invention, both as to its organization and manner of operation, together with further object and advantages thereof, may best be understood with reference to the following description, taken in connection with the accompanying drawings in which:

DETAILED DESCRIPTION OF THE PREFERRED EMBODIMENT(S)

As required, detailed embodiments of the present invention are disclosed herein. However, it is to be understood that the disclosed embodiments are merely exemplary of an invention that may be embodied in various and alternative forms. Therefore, specific functional details disclosed herein are not to be interpreted as limiting, but merely as a representative basis for the claims and/or as a representative basis for teaching one skilled in the art to variously employ the present invention.

Figure 1:
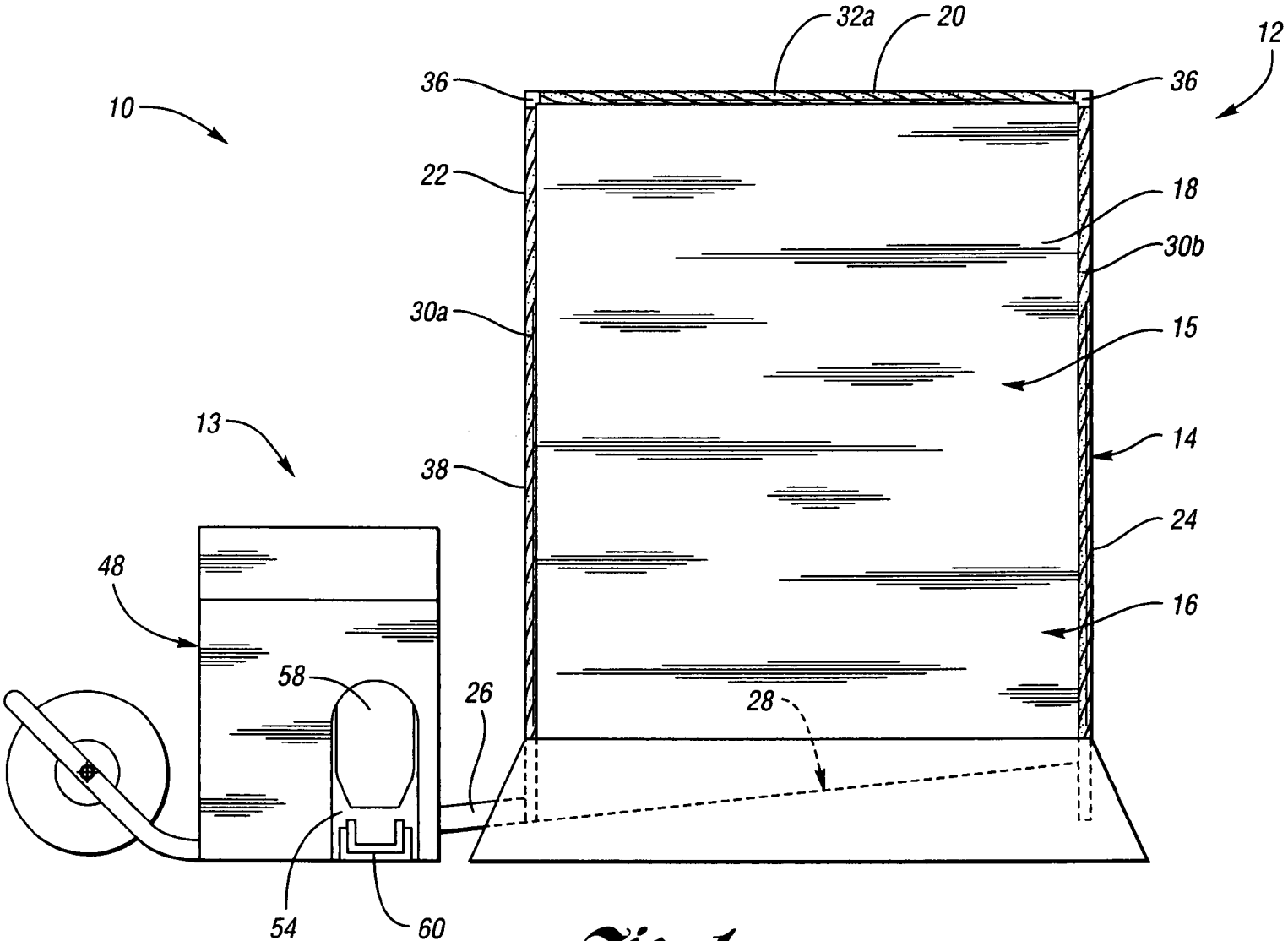
FIG. 1 is a front plan view of a ball practice machine in accordance with an aspect of the present invention.
Figure 2:
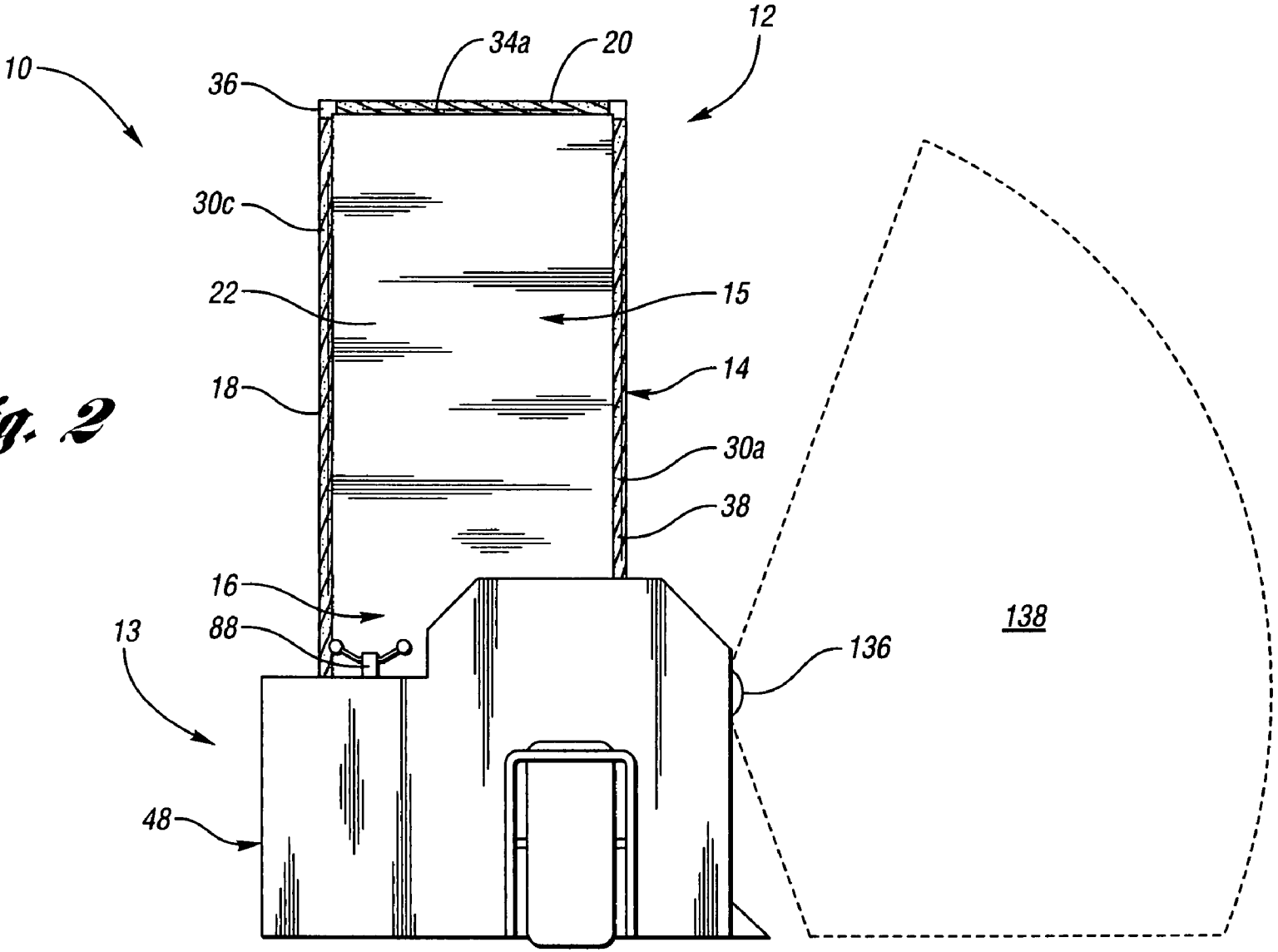
FIG. 2 is a side view of a ball practice machine in accordance with an aspect of the present invention.
Figure 3:
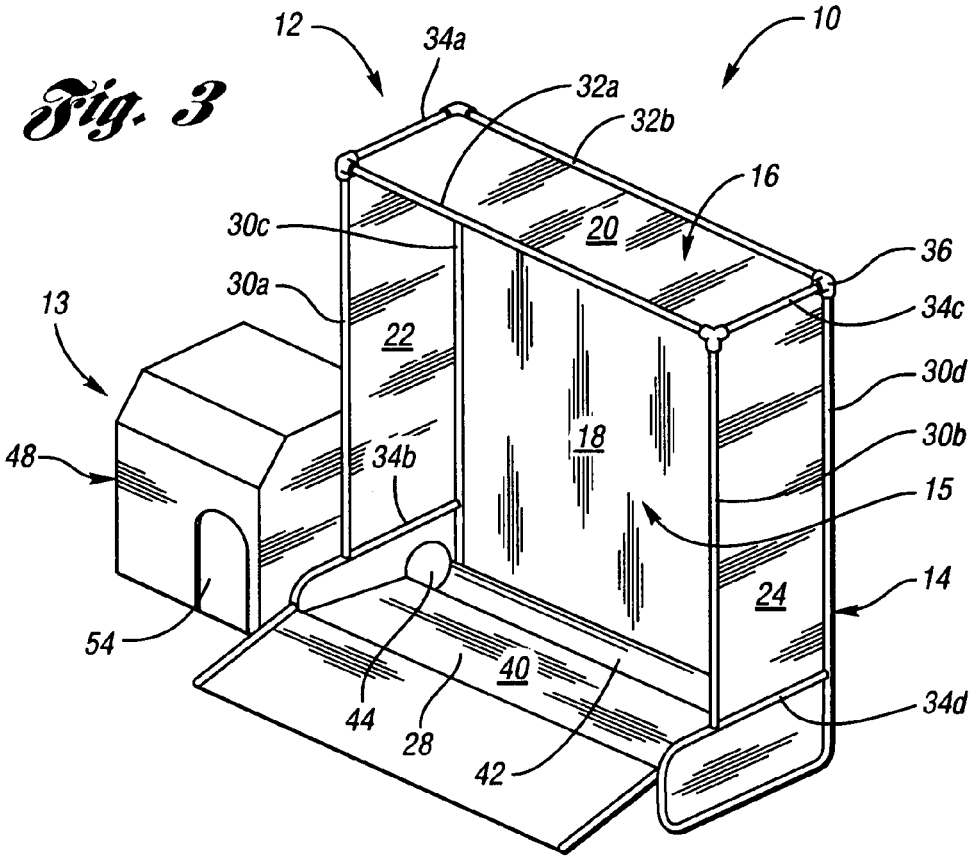
FIG. 3 is a perspective view of a ball practice machine in accordance with an aspect of the present invention.

A practice machine 10 for receiving a thrown ball and returning it to a user is illustrated in FIGS. 1–4. The practice machine 10 includes a backstop 12 and a ball return 13, as shown in FIGS. 1–3. The backstop 12 has two main components: a frame 14 defining a ball receiving chamber 15 and netting 16. The netting 16 provides a back wall 18, a roof 20, a left side wall 22 and a right side wall 24 for generally enclosing the ball receiving chamber 15, leaving a substantially open area for receiving a thrown ball into the chamber. The practice machine 10 may further include a trough 26 and a pan 28.

Referring generally to FIGS. 1–3, the frame 14 may include a pair of upright front support posts 30*a*–30*b* and a pair of upright rear support posts 30*c*–30*d*. The front support posts 30*a*–30*b* may be interconnected by a front upper transverse support member 32*a*, while the rear support posts 30*c*–30*d* may be interconnected by a rear upper transverse support member 32*b*. Optionally, the front support posts 30*a*–30*b* may be further interconnected by a front lower transverse support member (not shown) and the rear support posts 30*c*–30*d* may be further interconnected by a rear lower transverse support member (not shown). The frame 14 may also include an upper left fore-and-aft connecting arm 34*a* and a lower left fore-and-aft connecting arm 34*b* interconnecting the upright front support post 30*a* and the upright rear support post 30*c*, as well as an upper right fore-and-aft connecting arm 34*c* and a lower right fore-and-aft connecting arm 34*d* which interconnect upright front support post 30*b* and the upright rear support post 30*d*. At each intersection between upright support posts, fore-and-aft connecting arms and transverse support members, a three-way elbow 36 may be provided for connecting the respective support posts, connecting arms, and transverse members into the rigid frame 14.

The frame 14 provides support for the netting 16. The system of netting enclosing the ball receiving chamber 15 can be of any suitable material and construction for receiving a thrown ball without permitting it to pass therethrough. Moreover, the ideal netting material absorbs a sufficient amount of energy upon impact with a thrown ball to cause the ball to drop generally downward inside the ball receiving chamber 15 as opposed to rebounding outside. As non-limiting examples, the netting 16 can be formed from a mesh net, canvas, sheet, tarp, or any combination thereof. Any such material is fully contemplated herein, without departing from the scope of the present invention.

The netting defining the left side wall 22, the right side wall 24, the roof 20 and the back wall 18 may be held in position by cording 38 wrapped around the respective support posts, connecting arms, and transverse members. However, it is to be understood that any means of securing the netting 16 to the frame 14 while still allowing flexing of the netting 16 is fully contemplated by the present invention. Further, the support posts, connecting arms, and transverse members may be protected against occasional impact from the ball by padding (not shown) wrapped therearound and held in place by the cording 38. The padding can be of a variety of materials without departing from the scope of the present invention. Preferably, the left side wall 22 is defined by netting that extends in a substantially and normally vertical plane between front upright support post 30*a* and rear upright support post 30*c* and between the upper left fore-and-aft connecting arm 34*a* and the lower left fore-and-aft connecting arm 34*b*. Similarly, the right side wall 24 is defined by netting that extends in a substantially and normally vertical plane between front upright support post 30*b* and rear upright support post 30*d* and between the upper right fore-and-aft connecting arm 34*c* and the lower right fore-and-aft connecting arm 34*d*. Moreover, the roof 20 is defined by netting extending in a substantially and normally horizontal plane between the upper left fore-and-aft connecting arm 34*a* and the upper right fore-and aft connecting arm 34*c* and between the front upper transverse support member 32*a* and the rear upper transverse support member 32*b*. Lastly, the back wall 18 is defined by netting extending across the rear of the ball receiving chamber 15 between the rear upright support post 30*c* and the rear upright support post 30*d* and between the rear upper transverse support member 32*b* and the rear lower transverse support member 32*d*.

The pan 28 may be disposed underneath the backstop 12 forming a floor to the ball receiving chamber 15, as best shown in FIG. 3. The pan 28 can be mounted to the frame 14 such that it extends laterally between the left side wall 22 and the right side wall 24 and forwardly from the back wall 18. It is to be understood that the pan 28 may extend forwardly beyond the vertical plane generally defining the front of the ball receiving chamber 15. The pan 28 is preferably composed of a smooth panel surface 40 and a channel 42 for directing balls toward a backstop outlet 44. The panel surface 40 and the channel 42 may be declined sufficiently to permit the ball to be routed towards the backstop outlet 44 with the aid of gravity. For example, the panel surface 40 may be declined toward the channel 42 or declined toward the backstop outlet 44, or both. Meanwhile, the channel 42 may decline towards the backstop outlet 44. As illustrated herein, the backstop outlet 44 is positioned near the left side wall 22 of the backstop 12. It is to be understood that any pan configuration that routes the ball toward the backstop outlet 44 is fully contemplated by the present invention. Accordingly, the backstop outlet 44 can be positioned in any suitable location within the backstop 12 without departing from the scope of the present invention. For example, the backstop outlet 44 can be formed near the right side wall 24, the back wall 18, or in the pan 28 itself permitting the ball to exit the backstop 12 directly beneath the pan 28.

In an alternative embodiment, the frame 14 supporting the netting 16 may be configured without the front upright support posts 30*a*–30*b*. Rather, the pan 28 can provide the requisite support for the left and right side walls 22, 24. Moreover, it is possible to construct the frame 14 without the use of the left and right lower fore-and-aft connecting arms 34*b*, 34*d* and the lower transverse support members. Instead, the pan 28 can provide the requisite support structure at the base of the backstop 12.

Figure 4:
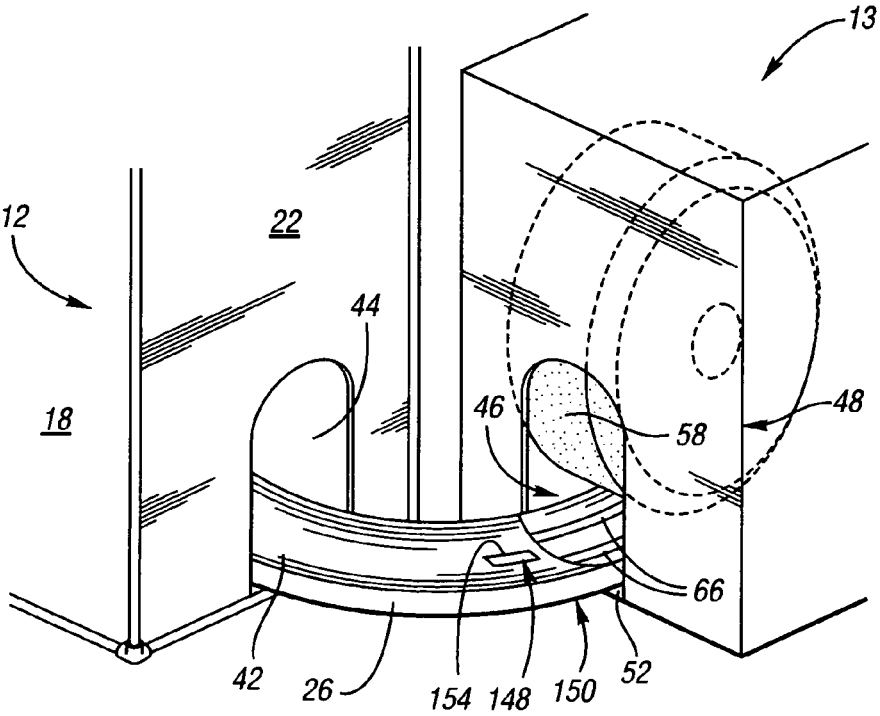
FIG. 4 is an alternate view of the trough in accordance with an aspect of the present invention.

With particular reference to FIG. 4, the trough 26 may be a U-shaped channel disposed between the backstop 12 and the ball return 13 extending from the backstop outlet 44 to a ball return inlet 46. Preferably, the trough 26 may have a substantially constant decline sufficient to permit the ball to be guided from the backstop 12 to the ball return 13 by gravity. Moreover, the trough 26 may be configured in any suitable shape that allows the ball to feed toward the ball return 13 after it exits the backstop 12. Accordingly, the trough 26 can have a generally linear shape, or alternatively, the trough 26 can have a gradual curve to it depending on the relative orientation of the backstop outlet 44 and the ball return inlet 46.

The ball return 13 is illustrated generally in FIGS. 1–4, and more particularly in FIGS. 5–8. In an embodiment of the present invention, the ball return 13 is enclosed within a housing 48 defining an inner chamber 50. The housing 48 includes an ingress 52 for receiving the ball into the inner chamber 50 and an egress 54 for expelling the ball therefrom. The ball return 13 may further include an electric motor 56, a rotatable wheel 58 and a trajectory adjustment mechanism 60. The trajectory adjustment mechanism 60 may have a stationary angle bracket 62, a movable launch plate 64 and a ball guide 66. The trough 26 can extend beyond the ingress 52 and terminate at the ball return inlet 46 where the ball is fed onto the ball guide 66. The ball guide 66 may be affixed to the launch plate 64. The launch plate 64 can be generally U-shaped and have a ball engaging surface 68 disposed between two outer walls 70*a*–70*b*. The ball engaging surface 68 is aligned with the ball guide 66 to permit a smooth transfer of the ball therebetween. The launch plate 64 may be disposed between the angle bracket 62 secured at the base of the ball return 13. The angle bracket 62 may have a pair of spaced-apart guide plates 72*a*–72*b*. The guide plates 72*a*–72*b* may be supported by a support brace therebetween. Each guide plate 72*a*–72*b* may include a corresponding arcuate slot 74*a*–74*b*. Each outer wall 70*a*–70*b* of the launch plate 64 may contain at least one sliding member 76, such as a guide pin or roller bearing, inserted into the corresponding arcuate slot 74*a*–74*b* to permit the launch plate 64 to travel forward and backward within the angle bracket 62 along a semi-circumferential path defined by the arcuate slots 74*a*–74*b*. As the launch plate 64 travels along the arcuate slots 74*a*–74*b* of the angle bracket 62, it pushes and pulls the ball guide 66 with it. Accordingly, the ball guide 66 is of sufficient length to provide for seamless transition of the ball from the trough 26 regardless of the position of the launch plate 64.

The electric motor 56 can be mounted to an inner support wall 78. The inner support wall 78 is rigidly supported by the housing framework. The motor 56 can be a variable speed motor and drives a spindle 80 upon which the rotatable wheel 58 is attached. The motor 56 may be mounted to the inner support wall 78 such that the rotatable wheel 58 is suspended generally above the angle bracket 62 a specified distance. As the ball enters the ball return 13, it rolls along the ball guide 66 to the ball engaging surface 68 of the launch plate 64. When the ball strikes the ball engaging surface 68, it also makes contact with the rotatable wheel 58 and the friction therebetween impels the ball forward out of the ball return 13.

The trajectory with which the ball is expelled from the ball return 13 can be varied by the trajectory adjustment mechanism 60. As the launch plate 64 slides progressively along the arcuate slots 74*a*–74*b* of the angle bracket 62, the ball engaging surface 68 can move from a substantially horizontal inclination to a substantially vertical inclination. The angle at which the ball engaging surface 68 is at the time the ball strikes the launch plate 64 determines the angle at which the ball is expelled from the ball return 13. Accordingly, the trajectory adjustment mechanism 60 permits the ball return 13 to expel ground balls, line drives, lobs, fly balls and pop flies, thus enabling a user to practice fielding in addition to throwing.

The launch plate 64 can be slidably driven along the angle bracket 62 in any number of ways. In one embodiment of the present invention, the trajectory adjustment mechanism 60 may further include at least one link rod 82, at least one pivot arm 84, and a lead screw 86 connected to a hand crank 88. The at least one link rod 82 has a proximal end 90*a* nearest the launch plate 64 and connected thereto. For example, the at least one link rod 82 can be connected to the at least one sliding member 76 in the outer wall 70*a*. The at least one link rod 82 also has a distal end 90*b* hingably attached to a first end 92*a* of the at least one pivot arm 84. The at least one pivot arm 84 also includes a second end 92*b* threadably attached to a threaded end 94 of the lead screw 86. The lead screw 86 may be affixed to the housing 48 such that the threaded end 94 is disposed within the inner chamber 50 internal to the housing 48 and the hand crank 88 is disposed external to the housing 48. The lead screw 86 can be secured in place by a lock collar 96 affixed to the underside of the housing 48, thereby permitting the lead screw 86 to turn in place upon rotation of the hand crank 88. As the lead screw 86 rotates, the second end 92*b* of the at least one pivot arm 84 travels along the threaded end 94 of the lead screw 86 causing the at least one pivot arm 84 to pivot about a pivot axis 98. As the at least one pivot arm 84 pivots, the at least one link rod 82 moves forward and backward, thereby pushing and pulling the launch plate 64 along the arcuate slots 74*a*–74*b* of the angle bracket 62 and thus varying the inclination of the ball engaging surface 68. Accordingly, the trajectory with which a ball is expelled from the ball return 13 is controlled by simple rotation of the hand crank 88.

In another embodiment, the launch plate 64 can be driven electrically by a trajectory control motor (not shown). For example, the trajectory control motor can be mounted near the rear of the angle bracket 62 and can drive an elongate lead screw (not shown) upon which the launch plate 64 is threaded. The motor can be activated by a bi-directional trajectory control switch (not shown). Activating the trajectory control switch to drive the motor in one direction, for example clockwise, rotates the lead screw causing the launch plate 64 to travel forward along the arcuate slots 74*a*–74*b*. Activating the trajectory control switch in the opposite direction, for example counter-clockwise, causes the launch plate 64 to travel backward along the lead screw retracing its path through the arcuate slots 74*a*–74*b*. Of course, it is to be understood that other means for adjusting the position of the launch plate 64 are fully contemplated by the present invention.

The ball return 13 may further include a ball diameter adjustment mechanism 106. The ball diameter adjustment mechanism 106 may include a slide base 108 slidably affixed to the inner support wall 78. The slide base 108 may be vertically movable between at least two positions. The motor 56 can be fixedly mounted to the slide base 108 such that the rotatable wheel 58 can lift and lower to at least two fixed distances relative to the ball guide 66. The at least two fixed distances may correspond to the diameter of a baseball and a softball. Additionally, the slide base 108 may be movable to a third position such that the rotatable wheel 58 is secured at a third fixed distance relative to the ball guide 66 corresponding to the diameter of a women's softball.

The ball diameter adjustment mechanism 106 can be implemented to manually adjust the motor height. Accordingly, the slide base 108 may include a plurality of slots 110*a*–110*d* for receiving a corresponding plurality of bolts 112*a*–112*d*. The plurality of bolts 112*a*–112*d* pass through the slots 110*a*–110*d* and are threadably attached to the inner support wall 78. Upon loosening the plurality of bolts 112*a*–112*d*, the motor 56 and slide base 108 can slide to the desired fixed position. Once the motor 56 and slide base 108 are in the desired fixed position, the plurality of bolts 112*a*–112*d* can be tightened securing the rotatable wheel 58 in place. Alternatively, the slide base 108 can be electromechanically adjusted using, for example, a servo motor and control circuit subsystem (not shown). Accordingly, a user can operate a ball diameter adjustment switch in communication with the control circuit to control the ball diameter adjustment mechanism 106. The ball diameter adjustment switch may be a multiple position switch (not shown), such as a two-position or three-position toggle switch corresponding to a particular sized ball to be expelled by the ball return 13.

The semi-circumferential path defined by the arcuate slots 74*a*–74*b* permits ball engaging surface 68 of the launch plate 64 to maintain a generally constant radial distance from the rotatable wheel 58 when the motor 56 is adjusted to its most desirable fixed position. The continuous equidistant spacing between the ball engaging surface 68 and the rotatable wheel 58, regardless of the location of the launch plate 64, allows the ball to be expelled with greater precision since the pitch point remains substantially constant. It is to be understood that the nominal adjustment for a different ball diameter has negligible effect on maintaining the desired substantially constant pitch point. The ball diameter adjustment mechanism's design is such that adjusting the motor 56 up or down produces only marginal differences in the radial spacing between the rotatable wheel 58 and the launch plate 64 as the launch plate 64 moves along the arcuate slots 74*a*–74*b*. Accordingly, the precision with which a ball is expelled is maintained notwithstanding the particular sized ball being used or the particular trajectory selected.

Figure 5:
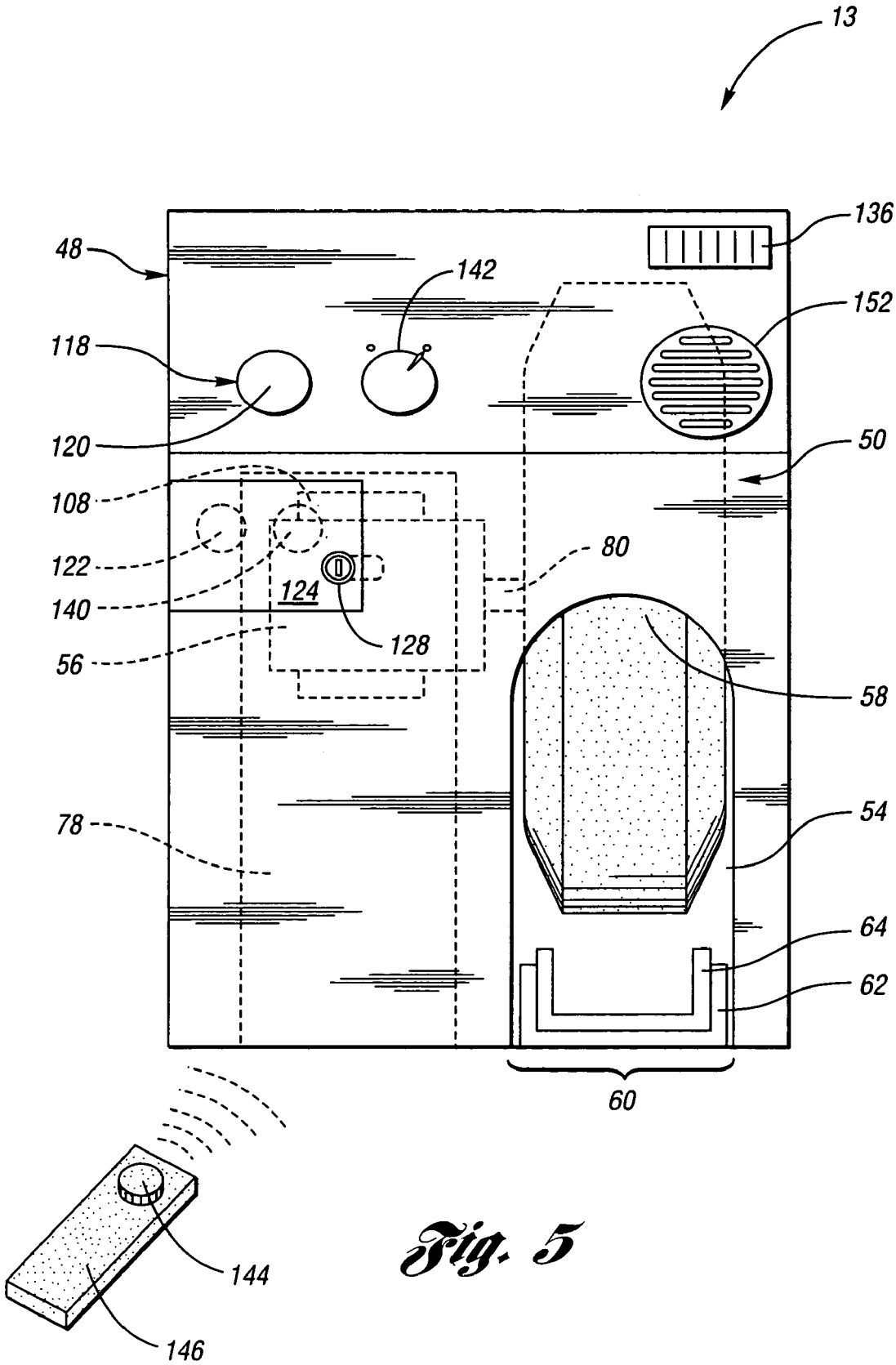
FIG. 5 is a front plan view of a ball return in accordance with an aspect of the present invention.
Figure 6:
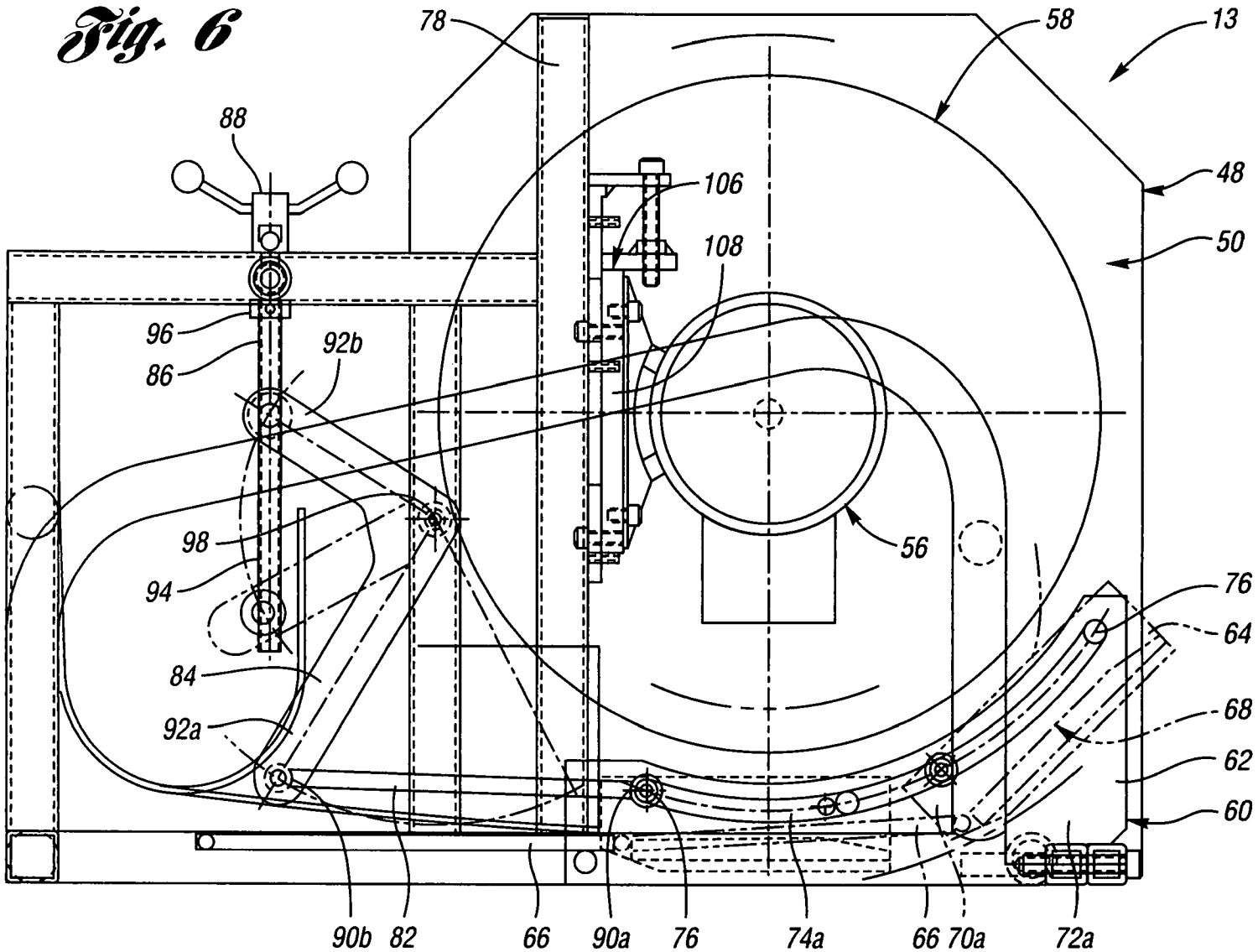
FIG. 6 is a side sectional view of a ball return in accordance with an aspect of the present invention.

Referring to FIG. 5, a speed control device 118 for adjusting the velocity with which the ball is expelled is illustrated. The speed control device 118 can be in electrical communication with the variable speed motor 56, thereby permitting a user to control the ball's velocity as it exits the ball return 13. For example, the speed control device 118 may include a speed control circuit (not shown) coupled to a potentiometer 120. The potentiometer 120 may be mounted to the exterior of the housing 48 for convenient access by the user. The user can adjust the ball velocity by adjusting the potentiometer 120. The speed control circuit can be any circuit known in the art for driving a variable speed motor. When used in combination with the trajectory adjustment mechanism 60, the speed control provides a more comprehensive fielding practice system. Variable speed control leads to variable control of both the horizontal and vertical distance components, thereby resulting in an even greater array of ball flights which can be expelled from the ball return 13 for practice in fielding.

A typical variable speed motor suitable for use with the present invention may be capable of expelling balls from the ball return 13 at a relatively high velocity. Certain speeds attainable by the ball return 13 are permissible for experienced users. However, many users may be endangered by balls hurled at very high speeds. In particular, users lacking sufficient skill, reflexes, and maturity may risk injury if the ball return 13 permits a ball to be expelled at an excessive velocity. Accordingly, the speed control device 118 may further include a speed control override 122 for limiting the maximum speed with which the ball is expelled from the ball return 13. It is to be understood that the speed control override 122 may be implemented through hardware or software via control logic. Regardless, a supervisory user, such as a coach, parent, guardian or other responsible adult or young adult, can limit the maximum velocity attainable so as to reduce the likelihood of harm or injury to an active user, particularly children.

The speed control override 122 can be tamper resistant or accessible only by a responsible supervisory user so as not to circumvent its intended purpose as a precautionary safety device. Preventing unwanted users from accessing the speed control override 122 can be obtained in any manner of ways. For example, the speed control override 122 can be positioned within the inner chamber 50 enclosed by the housing 48. To provide access to the speed control override 122, the housing 48 may further include an access panel 124 that, when removed, defines a passage 126 to the inner chamber 50. The access panel 124 may have a tamper resistant latch 128 for securing it to the housing 48. The latch 128 may be, for example, a lock or screw or other device to prevent unwanted access to the inner chamber 50, particularly, the speed control override 122.

Figure 7:
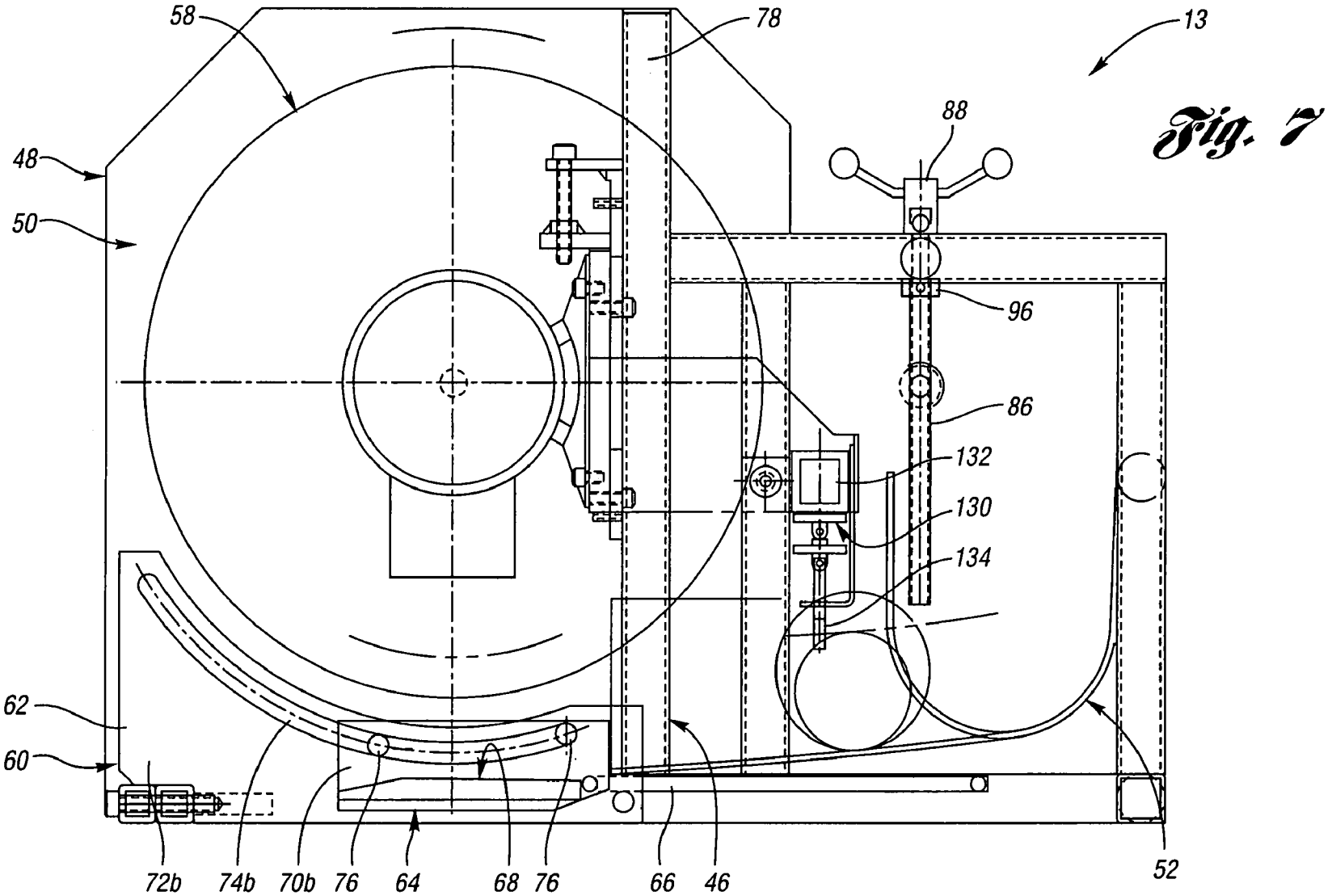
FIG. 7 is another side sectional view of a ball return in accordance with an aspect of the present invention.
Figure 8:
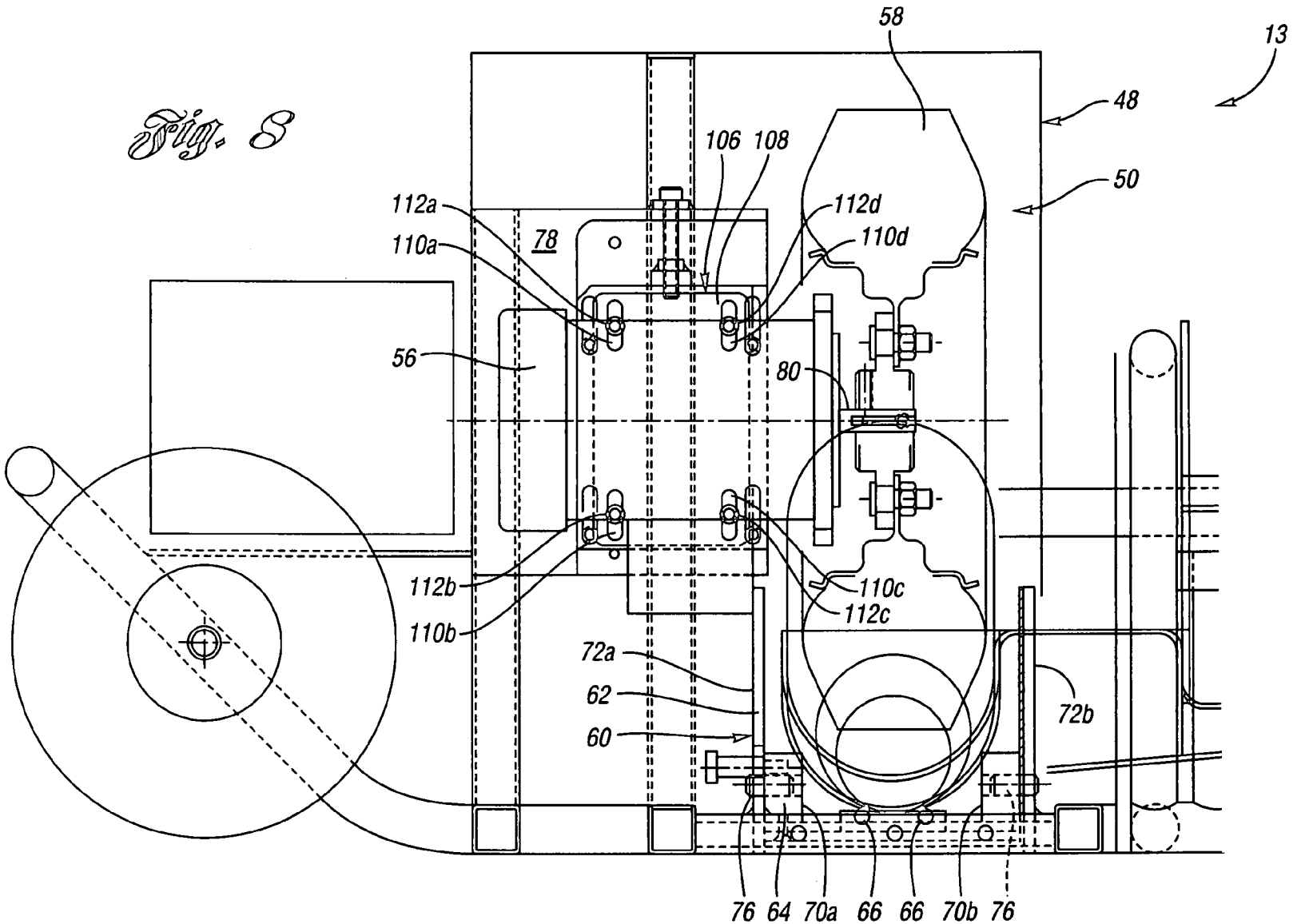
FIG. 8 is a front sectional view of a ball return in accordance with an aspect of the present invention.

In another embodiment of the present invention, the practice machine 10 may include an electro-mechanical stop 130 affixed above the trough 26 for obstructing the ball's path to the ball return 13. The stop 130 of the present invention is illustrated in FIG. 7. As a non-limiting example, the stop 130 can be a solenoid 132 which plunges a stop pin 134 downward towards the trough 26 a sufficient depth to obstruct the ball's path. The stop 130 is deployed by an activation signal which activates the solenoid 132. Preferably, the stop 130 is positioned above the trough 26 nearest the ball return 13 so that a ball can still be obstructed at or near the last possible moment prior to entering the ball return 13.

The activation signal for deploying the stop 130 can be generated in any number of ways. One particular implementation of the stop 130 can be made in combination with a proximity sensor 136. The proximity sensor 136, shown in FIGS. 2 and 5, can be electrically coupled to the stop 130 and affixed to the front of the practice machine 10 in any suitable location such that it is capable of detecting motion within a specified danger zone 138. The danger zone 138 defines a volume of space generally forward of the practice machine 10 and extending radially outward a certain distance deemed safe by the manufacturer or user. Movement by objects, such as children, within the danger zone 138 can be detected by the proximity sensor 136, which then transmits the activation signal to the stop 130 causing it to obstruct any ball that is about to be fed into the ball return 13. The stop 130 may remain deployed a set amount of time following the last incident of motion detection. Further, the proximity sensor 136 may include a danger zone control 140 for adjusting the detection sensitivity or danger zone volume. Like the speed control override 122, the danger zone control 140 may also be tamper resistant. For example, the danger zone control 140 may be located in the inner chamber 50 and enclosed by the housing 48 such that access can be gained by unlatching the access panel 124.

An alternate implementation for the stop 130 can be made in conjunction with a mode switch 142. The mode switch 142, shown in FIG. 5, can be electrically coupled to the stop 130 to toggle the practice machine 10 between an AUTO mode and a MANUAL mode. In the AUTO mode, the stop 130 can be normally deactivated permitting a thrown ball to feed to the ball return 13 unobstructed for automatic return to the user. In the MANUAL mode, the stop 130 can be normally activated by the activation signal, thereby obstructing the thrown ball from entering the ball return 13 and preventing automatic return to the user. The ball is released to the ball return 13 upon receipt of a deactivation signal by the stop 130. The deactivation signal is triggered by a user accessible trigger switch 144. The trigger switch 144 is coupled to the stop 130 and can be affixed to the exterior of the housing. Alternatively, the trigger switch 144 can be mounted in a remote 146, such as a wired remote or a wireless remote. The remote 146 permits an instructor or the user to release the ball to the ball return 13 upon command. The MANUAL mode is useful when the instructor wishes to teach or critique the user on throwing technique or desires to monitor the user's rate of throwing, among other things. For example, the instructor may wish to critique a previous throw or fielding technique. After the instructor is finished instructing, the instructor or the user may deploy the trigger switch 144, thereby deactivating the stop 130 and permitting the ball to be expelled.

Of course, it is to be understood that the mode switch 142 can be operable in combination with the proximity sensor 136. In such an instance, an activation signal transmitted by the proximity sensor 136 to deploy the stop 130 can take priority over the signals generated by the mode switch 142 and accompanying hardware, regardless of the mode setting. Thus, the precautionary safety measure provided by the proximity sensor 136 can remain in tact.

In still another embodiment of the present invention, the trough 26 may further include a ball detection device 148 for detecting the presence of a ball that passes thereby. The ball detection device 148, best shown in FIG. 4, may be disposed at a terminal end 150 of the trough 26 adjacent the ball return 13. A loudspeaker 152 affixed to the practice machine 10, as shown in FIG. 5, may be in electrical communication with the ball detection device 148. Upon detection of the presence of a ball by the ball detection device 148, prior to entering the ball return 13, the loudspeaker 152 can transmit an audible alert signal indicating that the ball is about to be expelled. The alert signal reminds users or nearby spectators to remain alert for an expelled ball, thereby reducing the likelihood of injury caused by inattentiveness. The ball detection device 148 can be any suitable device for detecting the presence or absence of a nearby object. As a non-limiting example, the ball detection device 148 can be a micro-switch 154 disposed in the trough 26 that is depressed when the ball rolls by. Another example of a ball detection device 148 can be a laser light transmitter positioned to transmit a transverse beam of light across the trough 26 in the ball's pathway. A laser light receiver for receiving the transmitted beam of light can rest on an opposite side of the trough. As the ball passes by, it breaks the beam of light resulting in transmission of the alert signal.

Figure 9A:
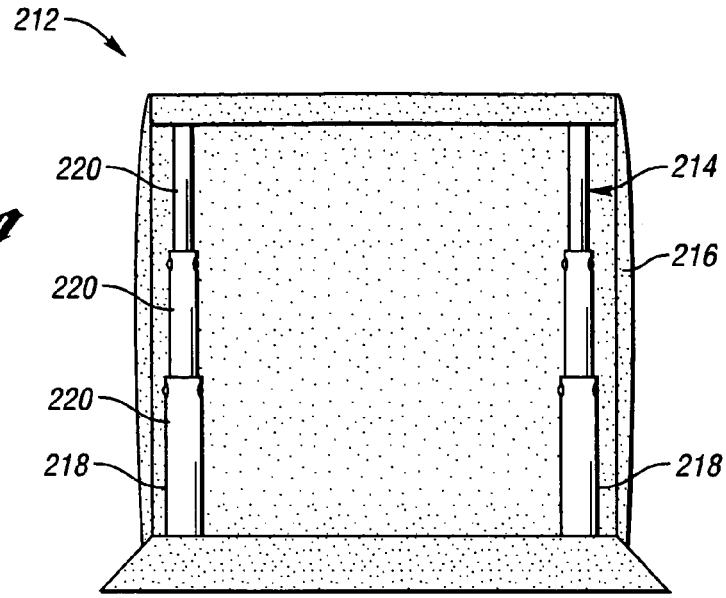
FIG. 9*a* is a front plan view of a fully expanded backstop in accordance with an aspect of the present invention.
Figure 9B:
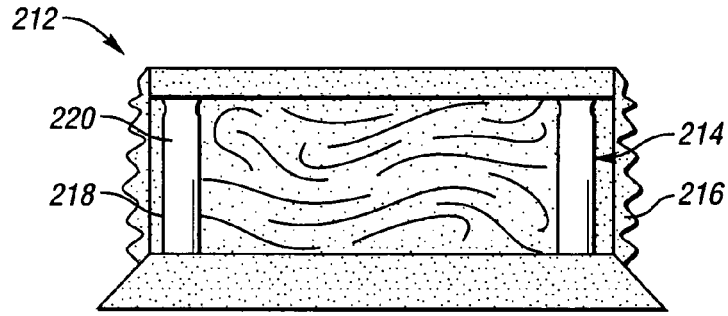
FIG. 9*b* is a front plan view of a collapsed backstop in accordance with an aspect of the present invention.
Figure 10A:
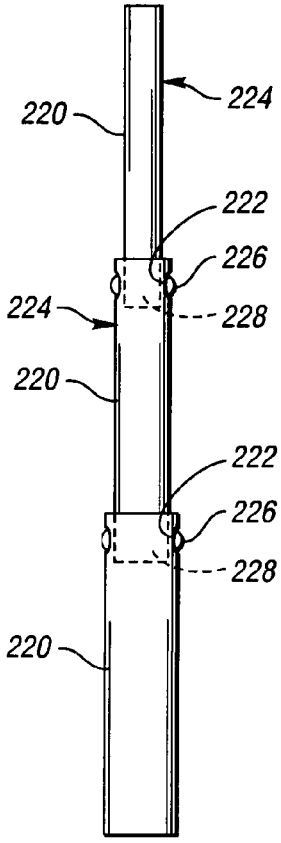
FIG. 10*a* depicts a collapsible upright support post in an elongated configuration in accordance with an aspect of the present invention.
Figure 10B:
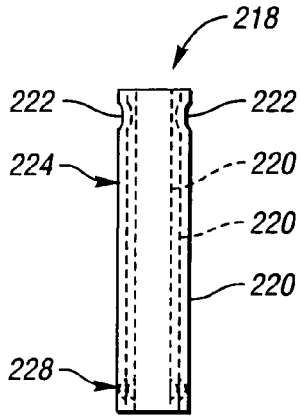
FIG. 10*b* depicts a collapsible upright support post in a collapsed configuration in accordance with an aspect of the present invention.

With regard to FIGS. 9*a*–10*b*, yet another embodiment of the present invention is shown. In particular, FIGS. 9*a* and 9*b* illustrate a collapsible backstop 212. The backstop 212 can be collapsible from a fully expanded target configuration, as shown in FIG. 9*a*, to a compact transportable configuration, as shown in FIG. 9*b*. When the practice machine 10 is in use, it may be desirable to have a fully expanded target area. However, the fully expanded backstop 212 may not be conducive for storage or transportation. Accordingly, the backstop 212 can be collapsed when not in use so that it takes up less space, and can be easily transported in a truck or van. Like the backstop 12, the collapsible backstop 212 may include a frame 214 and netting 216. The frame 214 may include a plurality of collapsible upright support posts 218. Each upright support post 218 may have a plurality of telescoping tubular members 220. Each telescoping tubular member 220 may be capable of extending substantially end-to-end in an elongated configuration, as shown in FIG. 10*a*. Moreover, each telescoping tubular member 220 may be capable of collapsing, one inside the next, in a collapsed configuration, as shown in FIG. 10*b*.

Each telescoping tubular member 220 may include at least one aperture 222 in a first end 224 and at least one detent 226 in a second end 228. As adjacent tubular members are extended end-to-end, the detent 226 of one tubular member can snap into the aperture 222 of another tubular member. As each tubular member is snapped in place, the plurality of telescoping tubular members 220 become secured in the elongated configuration. By depressing each detent 226, the corresponding tubular member can be collapsed within its adjacent tubular member having the corresponding aperture 222. Collapsing each tubular member 220 collapses the entire frame 214, thus lowering the backstop height to a more manageable size for transportation or storage, or both. For example, the collapsed backstop 212 can be loaded into the back of a sport utility vehicle or van, whereas a fully expanded backstop could not.

The netting 216 can be secured to the collapsible frame 214 and provides a target for receiving the thrown ball. The netting 216 may be formed from flexible material capable of collapsing with the frame 214. Thus, the backstop 212 can be collapsible from a fully expanded target configuration when the plurality of telescoping tubular members 220 are in the elongated configuration to a compact transportable configuration when the plurality of telescoping tubular members 220 are in the collapsed configuration.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A practice machine for receiving a thrown ball and returning it to a user, the machine comprising:

a backstop for stopping the ball thrown by the user;

a pan disposed beneath the backstop for collecting the ball after it strikes the backstop;

a ball return adjacent the backstop for expelling the ball, the ball return including a sub-frame, a motor mounted to the sub-frame, a spindle and a rotatable wheel affixed to the spindle and driven by the motor, the rotatable wheel having a wheel axis;

a trough interposed between the pan and the rotatable wheel for feeding the ball from the pan to the rotatable wheel; and a rigid launch plate supported by the sub-frame, the launch plate being disposed adjacent the trough and generally underneath the rotatable wheel for communication therewith enabling the ball to be expelled therefrom, the launch plate interposed between and cooperating with a pair of guides connected to the sub-frame collectively defining an arcuate path extending generally about the wheel axis such that the launch plate is adjustable to rotate generally about the wheel axis along the rotatable wheel periphery, while maintaining a generally constant radial clearance with the rotatable wheel, so that the trajectory of the expelled ball may be varied by the user.

2. The machine of claim 1, further comprising a unitary frame that integrally supports the backstop, the pan, and the ball return.

3. The machine of claim 1, wherein the launch plate is rigidly supported on at least two transverse sides by at least two followers on each side, the at least two followers adapted to engage at least one of the pair of guides, each guide including an arcuate slot for receiving the at least two followers and permitting the launch plate to slide along a semi-circumferential path corresponding to the arcuate slots.

4. The machine of claim 1, further comprising:

at least one link rod having a proximal end and a distal end, the proximal end fixedly attached to the launch plate;

at least one pivot arm that pivots about a pivot axis having a first end and a second end, the first end fixedly attached to the distal end of the link rod; and a lead screw affixed to the sub-frame by a lock collar and a hand crank positioned atop the frame, the lead screw having a threaded end and a crank end, the second end of the pivot arm being threadably attached to the threaded end of the lead screw;

wherein rotating the hand crank causes the pivot arm to pivot inducing the link rod to move foreward and aftward, thereby varying the position of the launch plate about the rotatable wheel periphery.

5. The machine of claim 1, wherein the motor is variable speed and includes a speed control device for adjusting the speed with which the ball is expelled from the ball return.

6. The machine of claim 5, further comprising a speed control override in communication with the speed control device for limiting the maximum speed at which the ball is expelled from the ball return.

7. The machine of claim 6, wherein the speed control override is temper resister.

8. The machine of claim 2, further comprising a housing mounted to the frame which generally encloses the ball return, the housing including an access panel for providing access to the ball return, the access panel having a tamper resistant latch preventing unwanted access to the ball return.

9. The machine of claim 1 further comprising an electromechanical stop affixed to the trough for obstructing the ball's path to the rotatable wheel upon receipt of an activation signal.

10. The machine of claim 9 further comprising a proximity sensor affixed to the machine and electrically coupled to the stop, the proximity sensor capable of detecting motion within a danger zone and subsequently sending the activation signal activating the stop to prevent the ball from engaging the rotatable wheel.

11. The machine of claim 10 further comprising a danger zone control for adjusting the danger zone.

12. The machine of claim 11, wherein the danger zone control is tamper resistant.

13. The machine of claim 9 further comprising a ball detection device for detecting the presence of the ball, the ball detection device being disposed in a terminal end of the trough adjacent the rotatable wheel, the detection device in communication with a loudspeaker affixed to the machine for transmitting an audible alert signal as the ball passes by the detection device just prior to engaging the rotatable wheel.

14. The machine of claim 9 further comprising a mode switch electrically coupled to the stop to toggle the machine between an AUTO mode and a MANUAL mode, wherein the stop is activated by the activation signal to obstruct the ball from entering the ball return when the mode switch places the machine in MANUAL mode, the stop being deactivated to release the ball to the ball return upon receipt of a deactivation signal triggered by a user accessible trigger switch, and the stop is generally deactivated to allow the ball to proceed unobstructed to the ball return when the mode switch places the machine in AUTO mode.

15. The machine of claim 14 wherein the trigger switch is mounted to a remote for sending the deactivation signal to the stop when the machine is in MANUAL mode.

16. The machine of claim 14, wherein the remote is wireless.

17. The machine of claim 14 further comprising a proximity sensor affixed to the machine and electrically coupled to the stop, the proximity sensor capable of detecting motion within a danger zone and activating the stop to prevent the ball from entering the ball return regardless of whether the machine is in the AUTO mode or MANUAL mode.

18. The machine of claim 9 further comprising a speed control device for adjusting the speed with which the ball is expelled from the machine, and a speed control override in communication with the speed control device for limiting the maximum speed at which the ball is expelled from the machine.

19. The machine of claim 18, wherein the speed control override is tamper resistant.

20. The machine of claim 9, further comprising a housing mounted to the frame which generally encloses the ball return, the housing including an access panel for providing access to the ball return, the access panel having a tamper resistant latch preventing unwanted access to the ball return.

21. The machine of claim 1 further comprising:

an elongate, unitary frame for supporting the backstop and the ball return, the frame centered about a transverse axis generally perpendicular to the direction of travel of the expelled ball; and a wheel affixed to the frame at a transverse end and aligned about the transverse axis such that the frame can be lifted at an opposite transverse end and transported in a direction along the transverse axis.

22. The machine of claim 21, wherein the backstop is collapsible in order to reduce the vertical height of the machine such that it may be loaded into a vehicle for transportation.

* * * * *

UNITED STATES PATENT AND TRADEMARK OFFICE

CERTIFICATE OF CORRECTION

PATENT NO. : 7,137,910 B2
APPLICATION NO. : 11/028857
DATED : November 21, 2006
INVENTOR(S) : James A. Kitson It is certified that error appears in the above-identified patent and that said Letters Patent is hereby corrected as shown below:

On the Title Page at field "12":

Delete "Ktson" and insert therefor -- Kitson --.

On the Title Page at field "(75)" labeled "Inventors:":

Delete "Ktson" and insert therefor -- Kitson --.

Column 12, Line 56, Claim 7:

Delete "temper resister" and insert therefor -- tamper resistant --.

Signed and Sealed this

Twentieth Day of March, 2007

JON W. DUDAS
*Director of the United States Patent and Trademark Office*